US012631400B2

(12) United States Patent
Janssens et al.

(10) Patent No.: US 12,631,400 B2
(45) Date of Patent: May 19, 2026

(54) GAS TREATMENT COMPONENT

(71) Applicant: Bosal Flanders NV, Lummen (BE)

(72) Inventors: Jean-Paul Hubert Janssens, Leopoldsburg (BE); Michel Dubuisson, JM Sittard (NL); Martijn Luyck, Hasselt (BE)

(73) Assignee: Bosal Flanders NV, Lummen (BE)

( * ) Notice: Subject to any disclaimer, the term of this patent is extended or adjusted under 35 U.S.C. 154(b) by 188 days.

(21) Appl. No.: 18/390,731

(22) Filed: Dec. 20, 2023

(65) Prior Publication Data

US 2024/0210118 A1 Jun. 27, 2024

(30) Foreign Application Priority Data

Dec. 22, 2022 (EP) ..... 22215742

(51) Int. Cl.
*F28D 9/00* (2006.01)
*F28F 3/02* (2006.01)

(52) U.S. Cl.
CPC ..... *F28D 9/0068* (2013.01); *F28D 9/0093* (2013.01); *F28F 3/025* (2013.01)

(58) Field of Classification Search
CPC .... F28D 7/0066; F28D 7/0083; F28D 7/0091; F28D 1/0325; F28D 1/0443; F28D 1/0452; F28D 9/0093; F28F 2250/106
See application file for complete search history.

(56) References Cited

U.S. PATENT DOCUMENTS 4,823,867 A * 4/1989 Pollard ..... F28D 9/0037 165/DIG. 356
2003/0203262 A1* 10/2003 Stukey ..... H01M 8/04074 422/198

(Continued)

FOREIGN PATENT DOCUMENTS

DE 202021103801 U1 11/2021
WO WO-02090860 A1 * 11/2002 ..... F28D 7/16

OTHER PUBLICATIONS

Translation of WO02090860A1 named Translation—WO02090860A1 (Year: 2002).*

(Continued)

*Primary Examiner* — Paul Alvare
(74) *Attorney, Agent, or Firm* — Merchant & Gould P.C.

(57) ABSTRACT

A gas treatment component includes a cross-flow heat exchanger and a counter-flow heat exchanger arranged in series with the cross-flow heat exchanger. The cross-flow heat exchanger and the counter-flow heat exchanger each include a core having a stack of heat exchanger plates, and the heat exchanger plates of the cross-flow heat exchanger form first channels for a first gas flow passing the cross-flow heat exchanger and form second channels for a second gas flow passing the cross-flow heat exchanger. A first distance between neighbouring heat exchanger plates forming the first channels is smaller than a second distance between neighbouring heat exchanger plates forming the second channels. The cross-flow heat exchanger includes a second outlet for the second gas flow to leave the cross-flow heat exchanger and a deflector plate for deflecting a portion of the second gas flow leaving the cross-flow heat exchanger at the second outlet.

20 Claims, 3 Drawing Sheets

(56) References Cited

U.S. PATENT DOCUMENTS

| | | | | |
|---|---|---|---|---|
| 2005/0097881 | A1* | 5/2005 | Shibata | F28D 9/0093 60/39.511 |
| 2006/0251943 | A1* | 11/2006 | Hatoh | H01M 8/04365 429/492 |
| 2010/0108042 | A1 | 5/2010 | Akiyoshi et al. | |
| 2013/0269910 | A1 | 10/2013 | De Piero et al. | |
| 2014/0026577 | A1 | 1/2014 | Reinke et al. | |
| 2014/0140829 | A1* | 5/2014 | Blair | F28D 15/00 415/177 |
| 2018/0187984 | A1* | 7/2018 | Manzo | F28F 13/12 |
| 2020/0108474 | A1* | 4/2020 | Thresher | B23P 15/26 |

OTHER PUBLICATIONS

Rafal Laskowski, "The concept of a new approximate relation for exchanger heat transfer effectiveness for a cross-flow heat exchanger with unmixed fluids", Journal of Power Technologies 91(2): 93-101 (2011).

Search Report for European Patent Application No. 22215742.2 (Jun. 1, 2023), 6 pages.

* cited by examiner

GAS TREATMENT COMPONENT

This application claims benefit of EP Application No. 22215742.2, filed on 22 Dec. 2022 in the European Patent Office and which application is incorporated herein by reference in its entirety. To the extent appropriate, a claim of priority is made to the above disclosed application.

The invention relates to a gas treatment component, in particular a gas treatment component including heat exchangers.

For example, from DE 20 2021 103 801U, a gas treatment system is known that allows to preheat two gas flows and comprises general optimization of, for example, operation of high temperature fuel cells when used in combination with the gas treatment system.

Optimization of such gas treatment systems are dependent on several parameters, such as, for example, thermal efficiency, or cost and space constraints. In particular, high efficiency heat exchangers are costly. Heat exchangers with high thermal efficiency often generate a high backpressure (pressure drop). This can be improved by making the heat exchangers larger in size, but as a consequence, the cost increase.

Therefore, there is a need for a gas treatment component optimizing the prior art gas treatment systems. In particular, there is need for an efficient gas treatment component with reduced cost and size.

According to the invention, there is provided a gas treatment component comprising a cross-flow heat exchanger and a counter-flow heat exchanger arranged in series with the cross-flow heat exchanger. Thus, the counter-flow heat exchanger is arranged downstream of the cross-flow heat exchanger with respect to a flow direction through the heat exchangers. The cross-flow heat exchanger and the counter-flow heat exchanger each comprise a core comprising a stack of heat exchanger plates. The heat exchanger plates of the cross-flow heat exchanger form first channels for a first gas flow passing the cross-flow heat exchanger and form second channels for a second gas flow passing the cross-flow heat exchanger. Therein, a first distance between neighbouring heat exchanger plates forming the first channels is smaller than a second distance between neighbouring heat exchanger pates forming the second channels of the cross-flow heat exchanger.

While several parameters may influence flow dynamics in a channel of a heat exchanger stack, the cross section of a channel is a main feature. Thus, in a heat exchanger stack, pressure drop is strongly influenced by the distance between neighbouring plates, thus a height of a channel, with a gas flow flowing in between the plates.

With large second channels, the pressure drop of the second gas flow in the cross-flow heat exchanger may be kept small. The large second channels provide for the passing of a high-volume flow, in particular a hot gas flow, but with small pressure drop. The smaller first channels are typically used for a low volume first flow, in particular a cold gas flow, causing little pressure drop when passing the cross-flow heat exchanger through the first channels of the cross-flow heat exchanger.

Cross-flow heat exchangers generally have a low thermal efficiency but may be manufactured at low cost. In addition, a first flow may be heated up, thereby cooling, possibly only slightly cooling, a second hot gas flow.

The so partially cooled second flow has a smaller volume flow compared to the initially hot second flow volume. Thus, volume flow of the second flow is smaller in the subsequent counter-flow heat exchanger and thus pressure drop through the counter-flow heat exchanger is reduced. A third gas flow in the gas treatment component is made to pass through the counter-flow heat exchanger in a counter-flow manner with the second gas flow. The third gas flow is a cold flow generally having a low volume flow and an according low pressure drop in the counter-flow heat exchanger.

The counter-flow heat exchanger has a high thermal efficiency due to its construction and working principle.

In general, if in a cross-flow heat exchanger and a counter-flow heat exchanger the product of the surface area and the heat transfer coefficient is identical for both heat exchangers, and if the two inlet flows have the same parameters (such as composition, mass-flow), counter-flow heat exchangers have a 10 percent better thermal effectiveness as compared to cross-flow heat exchangers.

In the present invention, the second gas flow is partially cooled in the cross-flow heat exchanger, such that the size of the counter-flow heat exchanger may be reduced as less heat has to be transferred to the third gas flow.

In addition, the size of a counter-flow heat exchanger may be reduced by increasing its thermal efficiency. The latter may be increased by reducing a cross-section of the second channels for the second gas flow. While a pressure drop generally gets larger when reducing a channel cross-section, such a pressure drop raise is limited in the present gas treatment component: The second gas flow has already partially been cooled in the cross-flow heat exchanger, so that the flow volume of the second flow through the counter-flow heat exchanger is lowered.

It has been found that an overall improvement of a gas treatment component may be achieved by treating hot gas with high volume flow in a cross-flow heat exchanger and subsequently treat the partially cooled hot gas then having lower flow volume in a counter-flow heat exchanger.

In summary, by the provision of a low cost, low efficient cross-flow heat exchanger, an overall pressure drop of the combined gas treatment component may be reduced and the cost of the counter-flow heat exchanger reduced. One large and costly counter-flow heat exchanger is replaced by a more cost-efficient combination of a low cost cross-flow heat exchanger and a more expensive but small counter-flow heat exchanger.

It has been found that a ratio between a height of first channels to a height of second channels may be optimized in view of low pressure drop with acceptable thermal efficiency in the cross-flow heat exchanger. Thus, overall optimization of the cross-flow heat exchanger may be achieved by selecting heat exchanger plate distances.

Preferably, a ratio of a second distance to a first distance is between 1.2 to 6. More preferably, a second distance to a first distance is between 1.5 to 4, even more preferably 1.5 to 3. These ratios of distances of neighbouring heat exchanger plates or heights of first channels in a cross-flow heat exchanger to second channels in the cross-flow heat exchanger, respectively, have provided optimized results with respect to heat efficiency under minimized pressure drop conditions. Such an optimization in particular applies to cross-flow applications with large volume hot gas flows in temperature ranges above, for example, 400 degree Celsius, in particular above 800 degree Celsius. This is preferably combined with low volume cold gas flows, for example having ambient temperature.

In the cross-flow heat exchanger, a distance between neighbouring heat exchanger plates of first channels and for a first gas flow, is preferably between 1 millimeter and 1.5 millimeter, more preferably 1 millimeter.

In the cross-flow heat exchanger, a distance between neighbouring heat exchanger plates of second channels and for a second gas flow, is preferably between 2 millimeter and 3 millimeter, more preferably 2 millimeter.

Cross-flow heat exchangers are known to have low thermal efficiency compared to a counter-flow heat exchanger and have low flow uniformity, in particular with respect to temperature uniformity at an outlet of the cross-flow heat exchanger.

In order to improve thermal efficiency of the cross-flow heat exchanger, a corrugated sheet may be arranged in between neighbouring heat exchanger plates.

Corrugated sheets may be arranged in between neighbouring heat exchanger plates in first channels or in between neighbouring heat exchanger plates in second channels of the cross-flow heat exchanger. Corrugated sheets may be arranged in between neighbouring heat exchanger plates in first channels and in second channels of the cross-flow heat exchanger.

Preferably, a corrugated sheet is arranged in between each neighbouring heat exchanger plates of a first channel of the cross-flow heat exchanger.

Preferably, a corrugated sheet is arranged in between each neighbouring heat exchanger plates of a second channel of the cross-flow heat exchanger.

Preferably, a corrugated sheet is arranged in between each neighbouring heat exchanger plates of the cross-flow heat exchanger.

Corrugated sheets arranged in channels create turbulences and enhance a contact surface with a gas flow flowing in the channel.

Corrugated sheets are preferably made of thermally conductive material such as, for example, metals, for example stainless steel.

A thickness of a corrugated sheet may be adapted to a size of the height of a channel, thus a distance between heat exchanger plates, where the corrugated sheet is arranged in between. A thickness of a corrugated sheet may, for example, be between 0.4 millimeter and 1.2 millimeter.

Preferably, heat exchanger plates of the cross-flow heat exchanger are flat plates.

Preferably, heat exchanger plates of the counter-flow heat exchanger are flat plates.

Flat plates are beneficial for welding and may be manufactured at low cost.

Heat exchanger plates are preferably made of thermally conductive material such as, for example, metals, for example stainless steel.

A thickness of a heat exchanger plate of the cross-flow heat exchanger and a counter-flow heat exchanger may be the same. Preferably, a thickness of a heat exchanger plate of a counter-flow heat exchanger is slightly smaller than a thickness of a heat exchanger plate of a cross-flow heat exchanger.

A thickness of a heat exchanger plate of a cross-flow heat exchanger may, for example, be between 0.15 millimeter and 2 millimeter, more preferably between 0.4 millimeter and 1.2 millimeter, for example 1 millimeter.

A thickness of a heat exchanger plate of a counter-flow heat exchanger may, for example, be between 0.1 millimeter and 2 millimeter, more preferably between 0.15 millimeter and 0.6 millimeter, for example 0.4 millimeter.

Preferably, the heat exchanger plates of the cross-flow heat exchanger and of the counter-flow heat exchanger are flat plates.

The flat heat exchanger plates may have a smooth plane surface or may comprise surface structures to optimize flow guidance in the heat exchanger (s). In particular, the heat exchanger plates of the counter-flow heat exchanger may comprise surface structures. Surface structure may, for example, be small protrusion or grooves, for example regular structures, such as for example, surface corrugations.

Preferably, heat exchanger plates with surface structures are provided in a counter-flow heat exchanger only.

The cross-flow heat exchanger comprises a first inlet and a first outlet for a first flow to enter and leave the cross-flow heat exchanger via the first inlet and outlet. The cross-flow heat exchanger also comprises a second inlet for a second gas flow to enter the cross-flow heat exchanger via the second inlet and a second outlet for the second gas flow to leave the cross-flow heat exchanger via the second outlet.

Preferably, a deflector plate is arranged at the second outlet of the cross-flow heat exchanger for deflecting a portion of the second gas flow leaving the cross-flow heat exchanger at the second outlet.

Cross-flow heat exchangers commonly have a low flow uniformity at an outlet of the heat exchanger, in particular a low temperature uniformity. Due to temperature differences, also pressure drop differences between partial flows in different channels of the cross-flow heat exchanger occur.

It has been found that a deflector plate arranged at an outlet of the cross-flow heat exchanger may improve flow uniformity. The deflector plate deflects a portion of an outlet gas flow and causes turbulence in the overall gas flow at or immediately downstream of the outlet of the cross-flow heat exchanger. In the gas treatment component of the present invention, portions of the second gas flow leaving the various second channels of the cross-flow heat exchanger are deflected by the deflector plate and mixed with other portions of the second gas flow leaving the cross-flow heat exchanger from the same and other second channels of the cross-flow heat exchanger. The so uniformed second flow may now enter the counter-flow heat exchanger.

A deflector plate covers a portion of an outlet of the cross-flow heat exchanger. This portion is large enough to achieve a desired quantity of turbulences and subsequent flow uniformity. In addition, said portion is small enough in order to obstruct the second gas flow only to an extent in order not to cause undesired pressure drop.

Preferably, a deflector plate covers between 30 percent and 70 percent of the second outlet of the cross-flow heat exchanger. More preferably, the deflector plate covers between 40 percent and 60 percent, even more preferably, the deflector plate covers 45 percent to 50 percent of the second outlet of the cross-flow heat exchanger.

These coverage ranges have provided good flow uniformity with little pressure drop.

A deflection of a portion of the second gas flow deviates the portion of the second gas flow from an original flow direction in the cross-flow heat exchanger, in particular from a gas flow direction at the outlet of the cross-flow heat exchanger. However, a main flow direction, for example a top-down direction, through the entire gas treatment component preferably remains the same.

A deflection of a portion of the second gas flow may be several degrees. A deflection of a portion of the second gas flow is preferably more than 50 degrees. Preferably, a deflection of a portion of the second gas flow has a maximum of 90 degrees.

Preferably, the deflector plate is arranged to deflect a portion of the second gas flow by 90 degrees. This may be achieved, for example, by attaching a deflector plate in the form of an end cover over a portion of the outlet of the cross-flow heat exchanger.

Good flow mixture of the second gas flow may thus be achieved with a very efficient, as well as space and cost saving provision and arrangement of a deflector plate.

Preferably, a deflector plate is a closed plate. 'Closed plate' is herewith understood as a deflector plate comprising no openings in that portion of the deflector plate that covers outlets of the second channels of the cross-flow heat exchanger. By this, it may be guaranteed that a portion of the second gas flow to be deflected is entirely deflected.

Preferably, a deflector plate is a flat plate.

Preferably, a deflector plate is arranged between a second outlet of a cross-flow heat exchanger and a second inlet of a counter-flow heat exchanger. Preferably, a deflector plate is arranged to cause a deflection of a second gas flow in a sideways direction or in a direction substantially perpendicular to a flow direction of the second gas flow when the second gas flow is leaving the cross-flow heat exchanger. The partially deflected second gas flow then mixes with the rest of the second gas flow that has not been deflected by the deflector plate. The so uniformed and in the cross-flow heat exchanger partially cooled second gas flow then enters the counter-flow heat exchanger. The second gas flow enters second channels formed by the stack of heat exchanger plates of the counter-flow heat exchanger.

Preferably, a deflector plate is arranged between a portion of outlets of the second channels of the cross-flow heat exchanger and a portion of inlets of the second channels of the counter-flow heat exchanger.

The deflector plate is arranged between a portion only of outlets of the second channels of the cross-flow heat exchanger and a portion only of inlets of the second channels of the counter-flow heat exchanger.

Through coverage of some inlets of the counter-flow heat exchanger, a second gas flow is not only uniformed with respect to temperature, the deflector plate also supports a distribution of the second gas flow into different second channels of the counter-flow heat exchanger. In addition, the deflector plate acts as pressure equalizer.

Through the supply of a uniform gas flow, thermal efficiency of a highly efficient counter-flow heat exchanger can fully be utilized.

A flow mixture of the second gas flow leaving the several second channels of the cross-flow heat exchanger may further be improved by a specific arrangement of the channels of the cross-flow heat exchanger in relation to the channels of the counter-flow heat exchanger.

The partial second gas flows passing different second channels of the cross-flow heat exchanger may have significant temperature differences at their channel outlets and a second gas flow leaving the cross-flow heat exchanger may show low flow uniformity. By rotating the arrangement of plate stacks of two subsequent heat exchangers against each other, flow uniformity may be improved in that partial gas flows leaving an upstream heat exchanger are guided into and divided into different channels of the subsequent heat exchanger.

The partial gas flows continue to flow in a substantially same direction through the cross-flow heat exchanger, when passing from the cross-flow heat exchanger to the counter-flow heat exchanger, as well as in the counter-flow heat exchanger. By this, a pressure drop of the second gas flow is minimized over these components. Due to the distribution of the partial gas flows into different channels in the counter-flow heat exchanger further flow mixture and homogenisation of the second gas flow may be achieved.

Preferably, planes of the heat exchanger plates of the cross-flow heat exchanger are arranged perpendicular to planes of the heat exchanger plates of the counter-flow heat exchanger. By this measure, a flow direction of a second gas flow in the counter-flow heat exchanger may be the same or parallel to a flow direction of the second gas flow in a preceding cross-flow heat exchanger. However, individual partial flows from the cross-flow heat exchanger are distributed over several channels in the counter-flow heat exchanger.

Preferably, the gas treatment component is arranged such that the second gas flow is a top-down flow, in the cross-flow heat exchanger as well as in the counter-flow heat exchanger.

Preferably, inlets and outlets of the cross-flow heat exchanger are arranged at opposite ends of the cross-flow heat exchanger.

Preferably, second inlet and second outlet of the counter-flow heat exchanger are arranged at opposite ends of the heat exchanger.

By this arrangement, an entire extension of the heat exchanger plates may be used for a heat exchange.

Preferably, second inlet and second outlet of a cross-flow heat exchanger are arranged at a top and a bottom of the cross-flow heat exchanger.

Preferably, second inlet and second outlet of a counter-flow heat exchanger are arranged at a top and a bottom of the counter-flow heat exchanger.

Gas flow uniformity may further be improved by the provision of perforation plates. A perforation plate may be provided at an inlet or at an outlet of a heat exchanger to uniform either an inlet gas flow or an outlet gas flow.

Preferably, a perforation plate is arranged at an inlet of a heat exchanger.

Preferably, a perforation plate is arranged to cover a first inlet or a second inlet of a cross-flow heat exchanger.

Preferably, a perforation plate is arranged to cover a first inlet and a second inlet of a cross-flow heat exchanger.

Perforations in a perforation plate may have any shape. However, preferably, perforations of a perforation plate have a round shape, preferably a circular shape.

Perforations may have a cross section between, for example, 2 millimeter and 5 millimeter, more preferably between 3 millimeter and 4 millimeter.

Preferably, a perforation plate is between 30 percent to 50 percent open by the sum of all perforations arranged in the perforation plate. More preferably, a perforation plate is between 40 percent and 45 percent open by the sum of all perforations arranged in the perforation plate.

Perforation plates provided at one or all heat exchangers of a gas treatment component may be identical in view of arrangement, number and size of perforations provided in the perforation plate. Preferably, number, size and arrangement of the perforations in a perforation plate are adapted to and may vary depending on a size of cross-sections and number of channels in a heat exchanger.

Preferably, no perforation plate is arranged at the outlets of the cross-flow heat exchanger.

The provision of a deflector plate at the outlet of a cross-flow heat exchanger has provided good effects in view of flow uniformity and cost.

Accordingly, preferably, a perforation plate at the second inlet of a subsequent counter-flow heat exchanger may be omitted.

Connection of a cross-flow heat exchanger and a counter-flow heat exchanger is preferably done in a simple and thermally efficient manner. For example, the gas treatment component may comprise a connection cone connecting a cross-flow heat exchanger and a counter-flow heat exchanger and make up for size differences of the two components.

If more than one counter-flow heat exchanger is provided, a connection cone preferably connects the cross-flow heat exchanger as well as the more than one counter-flow heat exchanger.

Preferably, a connection cone is arranged to cover lateral sides of a cross-flow heat exchanger and a second inlet of a counter-flow heat exchanger.

The gas treatment component may comprise one cross-flow heat exchanger and one counter-flow heat exchanger arranged in series with and downstream of the cross-flow heat exchanger.

While the cross-flow heat exchanger preferably has a simple set-up with specific channel size ratios as described above, a counter-flow heat exchanger may, for example, be constructed as described in EP3217132B1. In particular with respect to a plate arrangement, positions of inlet openings and outlet openings to achieve a counter-flow regime with maximum heat exchange, reference is made to the construction of a counter-flow heat exchanger as described in EP3217132B1.

A gas treatment component may comprise two or more counter-flow heat exchangers, wherein each of the two or more counter-flow heat exchangers is arranged in series to the cross-flow heat exchanger. Preferably, the gas treatment component comprises two to six counter-flow heat exchangers, more preferably two to four counter-flow heat exchangers, for example two counter-flow heat exchangers arranged in series to the cross-flow heat exchanger. In embodiments of the gas treatment component comprising more than one counter-flow heat exchanger, the counter-flow heat exchangers are preferably arranged in parallel to each other with respect to the second flow passing from the cross-flow heat exchanger into the counter-flow heat exchangers.

Preferably, at least two of the two or more counter-flow heat exchangers are identical in construction. More preferably, all of two or more counter-flow heat exchangers are identical in construction.

Preferably, two or more counter-flow heat exchangers are arranged symmetrically with respect to the cross-flow heat exchanger.

In preferred embodiments of the gas treatment component, a cross-flow heat exchanger is arranged vertically above a counter-flow heat exchanger such that a flow direction of the second gas flow in the counter-flow heat exchanger and in the cross-flow heat exchanger corresponds to a top-down flow direction. Such an arrangement allows for an overall improved second gas flow through the gas treatment component. It also allows fora compact design of the gas treatment component, in particular if more than one counter-flow heat exchanger is present.

Applications of the gas treatment component according to the invention are many, where heat recovery and thermal gas treatment is required. The gas treatment component is particularly suitable in applications were two different gas flows have to be treated, in particular preheated.

Use of the gas treatment component may, for example, be in the chemical process industry or in power generation. Hot waste or exhaust gas may be used for preheating at least two different gas flows as well as for heat recovery. The gas treatment component may, for example, be used in combination with at least one fuel cell or fuel cell stack, in particular a high temperature fuel cell, such as, for example, a solid oxide fuel cell.

The gas treatment component may, for example, be used in a combined heat and power system. The power system may, for example be powered by a micro gas turbine or a Stirling engine.

The invention also refers to a gas treatment system comprising a gas treatment component according to the invention and as described herein. The gas treatment system comprises a housing comprising several openings, wherein the gas treatment component is arranged in the housing and is fluidly connectable through the several openings in the housing with gas sources and gas receivers arranged external to the housing.

Compactness of the gas treatment component and an according system is advantageous not only with respect to an available space, but also with respect to cost and energy efficiency.

A small housing has a smaller surface that may emit heat to the surrounding. This heat is lost for use in the system and for energy recovery. In addition, cavities in the housing are commonly filled with a thermal insulation material. Smaller and lower numbers of cavities require less thermal insulation material. Thus, material cost may be reduced.

Preferably, the housing is an insulation box containing thermal insulation material.

Preferably, cavities in the housing are filled with thermal insulation material. The thermal insulation material may be any thermal insulation material suitable for this purpose. Preferably, the thermal insulation material is a microporous thermal insulation material. Preferably, a thermal insulation material is a thermally insulating powder, for example, a microporous powder with low thermal conductivity. Such a material enables a good distribution of the thermal insulation material, in particular in small gaps and hardly accessible parts in the housing.

Preferably, a thermal insulation material comprises a specific heat conductivity of less than 0.07 W/K*m. Preferably, the thermal insulation material, as well as the materials used in the gas treatment component or in the gas treatment system are resistant to high temperatures. Preferably, these materials comprise a temperature resistance of at least 750 degree Celsius or 950 degree Celsius.

Depending on the kind of application of the system, further components may be arranged in the housing or connected externally to the housing.

For example, a catalytic burner may be arranged in the housing, which may be fluidly connected to the counter-flow heat exchanger.

For example, a reformer may be arranged in the housing and may be fluidly connected to the cross-flow heat exchanger.

For example, at least one fuel cell, in particular a high temperature fuel cell such as a solid oxide fuel cell (SOFC) may be connected, in particular attached, to the housing. In such applications, used-up anode and cathode gas of the fuel cell(s) is treated in the gas treatment component. In particular, reformer gas to be used in the fuel cell is preheated in the cross-flow heat exchanger. In the counter-flow heat exchanger, the already slightly cooled used-up anode and cathode gas of the fuel cell is used to preheat fresh cathode gas for the fuel cell.

With the gas treatment component according to the invention it is possible to construct a very compact device having reduced size. The specific combination and design of cross-flow heat exchanger and counter-flow heat exchanger allows for good thermal efficiency at reduced total cost due to an overall small pressure drop over the entire gas treatment component despite or because of reduced sizes of individual elements.

The invention also refers to a method for the treatment of gas in a gas treatment component according to the invention and as described herein. The method comprises: providing a first gas flow and a second gas flow, and letting the first gas flow and the second gas flow pass a cross-flow heat exchanger in a cross-flow manner. Thereby, the second gas flow is partially cooled and the first gas flow is heated. The method further comprises letting the second flow leaving the cross-flow heat exchanger pass a counter-flow heat exchanger, and providing a third gas flow, and letting the third gas flow and the second gas flow pass the counter-flow heat exchanger in a counter-flow manner. Thereby, the second flow is further cooled and the third gas flow is heated. Therein, a mass flow of the first gas flow in the cross-flow heat exchanger is between 5 percent and 50 percent of the second gas flow in the cross-flow heat exchanger.

Preferably, the mass flow of the first gas flow in the cross-flow heat exchanger is between 8 percent and 40 percent of the second gas flow in the cross-flow heat exchanger. More preferably, the mass flow of the first gas flow in the cross-flow heat exchanger is between 10 percent and 30 percent of the second gas flow in the cross-flow heat exchanger.

Preferably, a total pressure drop of the second gas flow in the cross-flow heat exchanger and in the counter-flow heat exchanger does not exceed 50 mbar. More preferably, the total pressure drop in the cross-flow and counter-flow heat exchanger does not exceed 35 mbar. Most preferably, the total pressure drop in the cross-flow and counter-flow heat exchanger does not exceed 20 mbar.

Preferably, a total pressure drop of the second gas flow in the cross-flow heat exchanger does not exceed 10 mbar. More preferably, the total pressure drop of the second gas flow in the cross-flow heat exchanger does not exceed 5 mbar.

Preferably, the second gas flow is a hot gas flow, preferably having a temperature between 400 degree Celsius and 1000 degree Celsius before entering the cross-flow heat exchanger. Preferably, the temperature of the second gas flow is between 500 degree Celsius and 850 degree Celsius before entering the cross-flow heat exchanger.

Preferably, the first gas flow and the third gas flow are cold gas flows, for example having ambient temperature.

The first gas flow may, for example, be a natural gas or other gaseous fuel.

The third gas flow may, for example, be air or oxygen.

The second gas flow may, for example, be an exhaust gas flow, for example of a Stirling engine, a micro-gas turbine or a fuel cell such as a high temperature fuel cell, for example a solid oxide fuel cell (SOFC).

Preferably, the second gas flow has a vertical top-down flow direction in a cross-flow heat exchanger and preferably also in a counter-flow heat exchanger. Preferably, the second gas flow direction is kept substantially vertically in the cross-flow heat exchanger as well as in the counter-flow heat exchanger. A second gas flow direction in the cross-flow heat exchanger is substantially parallel to the second gas flow direction in the counter-flow heat exchanger. The flow direction of the second gas flow may divert from the exact vertical, in particular in manifolds upstream or downstream of a heat exchanger or also in interface components between the cross-flow heat exchanger and the counter-flow heat exchanger. In particular, a portion of the second flow may be deflected at the outlet of the cross-flow heat exchanger by a deflector plate (see also above).

In preferred embodiments of the present invention, the upstream arranged cross-flow heat exchanger comprises straight channels for both flows. The channels for one of the two flows are wider that the channels for the other of the two flows. Thus, thermal effectiveness of the cross-flow heat exchanger is low (product of heat transfer times surface area) but also the pressure drop in the cross-flow heat exchanger is very low. The subsequent counter-flow heat exchanger comprises narrow channels and small surface areas. The channels of the counter-flow heat exchanger comprise bends. These features raise the cost of such a counter-flow heat exchanger and also pressure drop but also lead to a large heat transfer coefficient.

Further features and advantages have been described relating to the gas treatment component or the gas treatment system.

The invention is further described with regard to embodiments, which are illustrated by means of the following drawings, wherein.

In the drawings, the same reference signs are used for the same or similar elements.

Figure 1:
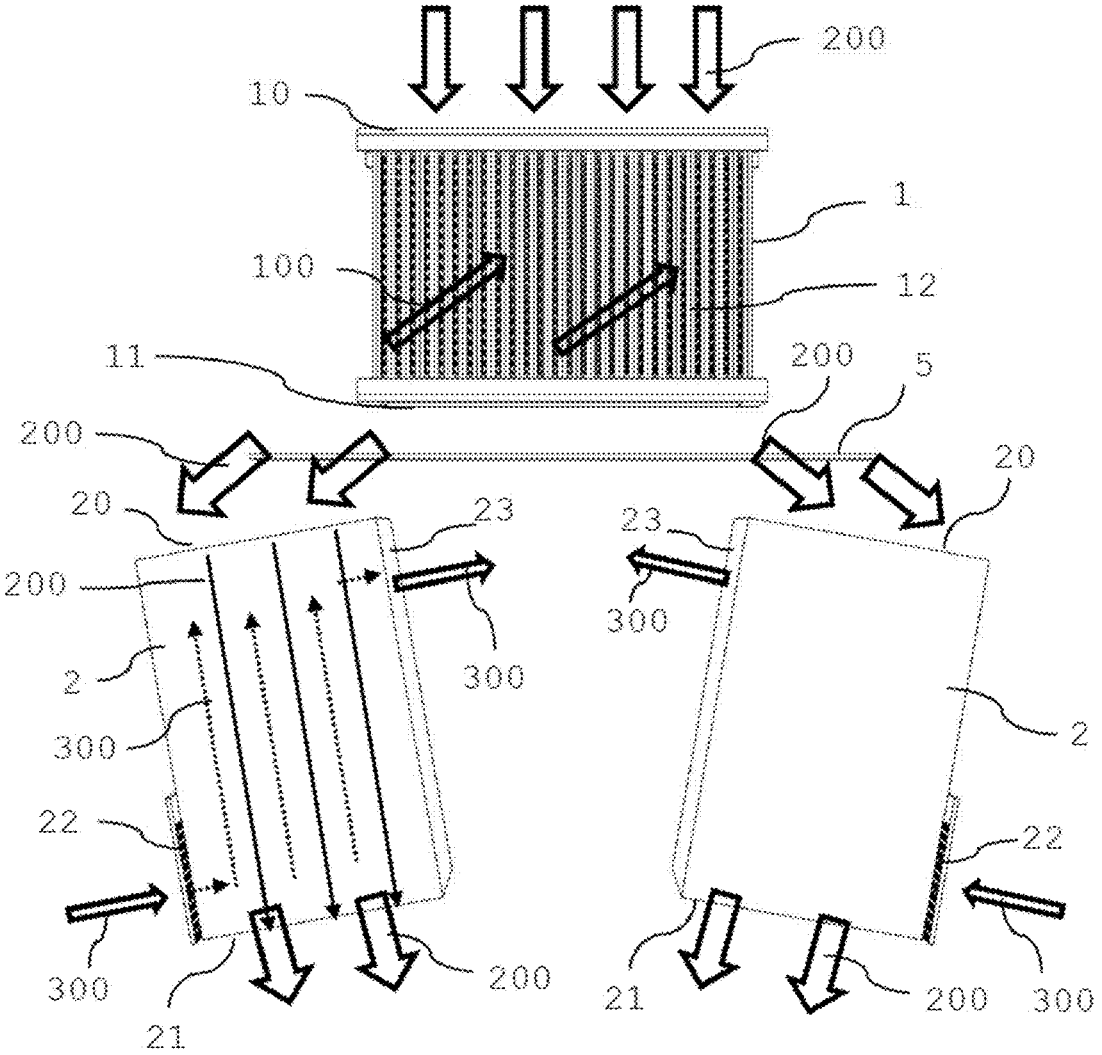
FIG. 1 shows a gas treatment component.

FIG. 1 shows a gas treatment component comprising a cross-flow heat exchanger 1 and two counter-flow heat exchangers 2. The two counter-flow heat exchangers 2 are arranged in parallel to each other and in series with the cross-flow heat exchanger 1 with respect to a second gas flow 200. The second gas flow 200 is a hot gas flow with a high flow volume, for example an exhaust gas flow of temperatures between 700 degree Celsius and 900 degree Celsius.

The cross-flow heat exchanger 2 and the counter-flow heat exchangers 2 are arranged above each other such that the second gas flow 200 performs a top-down movement through the gas treatment component.

The two counter-flow heat exchangers 2 are identical in construction. The two counter-flow heat exchangers 2 are arranged distanced from each other leaving space for a third gas flow 300 to leave the counter-flow heat exchangers 2 in a space between the two counter-flow heat exchangers 2.

A deflector plate 5 is arranged parallel to and covering part of the second outlet 11 of the cross-flow heat exchanger 1.

The deflector plate 5 is arranged between the cross-flow heat exchanger 1 and the two counter-flow heat exchangers 2. The deflector plate 5 also covers a part of the second inlets 20 of the counter-flow heat exchangers 2.

In the embodiment shown in FIG. 1, the two counter-flow heat exchangers are arranged at an angle to the plane of the second outlet 11 of the cross-flow heat exchanger 1 and to the plane of the deflector plate 5. With an angled arrangement additional space may be provided for a manifolding and tubing of the heat exchangers 1,2.

The second hot gas flow 200 enters the cross-flow heat exchanger 1 at the top of the gas treatment component and at the second inlet 10 of the cross-flow heat exchanger 1. The second gas flow passes the cross-flow heat exchanger 1 vertically in a top-down direction and leaves the cross-flow heat exchanger at the second outlet 11 arranged at the bottom of the cross-flow heat exchanger 1.

A first cold flow 100, for example a fuel or natural gas at room temperature, enters the cross-flow heat exchanger 1 at a first inlet 12 (at its front side of FIG. 1) and passes the cross-flow heat exchanger 2 perpendicular to the second gas flow 200. The first flow 100 leaves the cross-flow heat exchanger 1 as a preheated first flow 100 at the back side of the cross-flow heat exchanger 1 (not seen in FIG. 1).

The partially cooled second gas flow 200 leaves the cross-flow heat exchanger 1 and is partially deflected by the deflector plate 5. The partially deflected portion of the second gas flow 200 mixes with the rest of the second gas flow 200 leaving the cross-flow heat exchanger. The so mixed and uniformed second gas flow 200 enters the two counter-flow heat exchangers 2 at the second inlets 20 of the counter-flow heat exchangers 2 arranged at the top ends of the counter-flow heat exchangers 2. The second gas flow 200 passes the counter-flow heat exchangers 2 in a top-down direction and leaves the two counter-flow heat exchangers 2 at their respective second outlets 21 at the bottom of the counter-flow heat exchangers 2.

A third cold flow 300, for example air at room temperature, enters the counter-flow heat exchangers 2 at respective third inlets 22 arranged at sides of the counter-flow heat exchangers 2.

Each third gas flow 300 passes the respective counter-flow heat exchanger 2 parallel to the second gas flow 200 in bottom to top direction (indicated by dashed lines in FIG. 1). The preheated third gas flows 300 leave the counter-flow heat exchangers 2 at respective third outlets 23 arranged at respective opposite sides of the counter-flow heat exchangers 2.

Heat of the second gas flow 200 is effectively transferred to the third gas flows 300 in the counter-flow heat exchangers 200, preheating said third gas flows 300.

Figure 2:
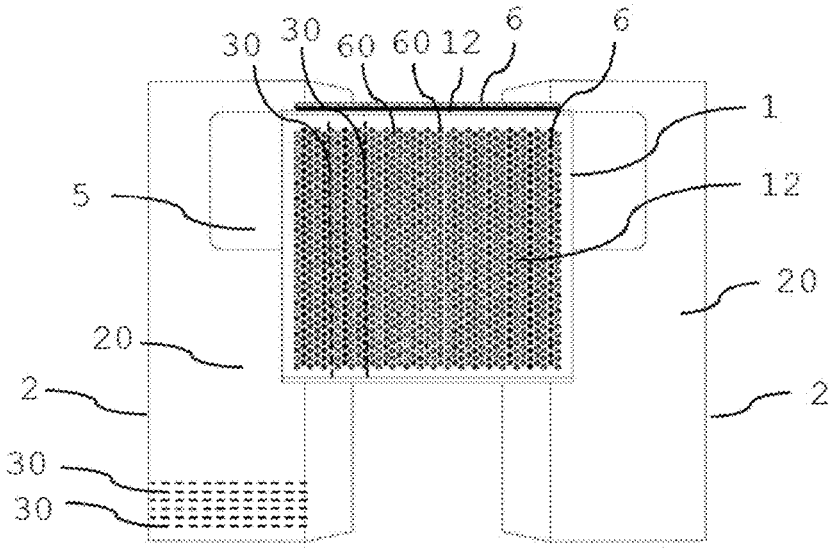
FIG. 2 is a top view of the gas treatment component of FIG. 1.

FIG. 2 shows the gas treatment component of FIG. 1 in a top view.

The cross-flow heat exchanger 1 is arranged on top of the two counter-flow heat exchangers 2 almost in between the counter-flow heat exchangers 2. In the example shown in FIG. 2, the cross-flow heat exchanger 1 is arranged laterally displaced to a lateral top side of the two counter-flow heat exchanger 2.

The cross-flow heat exchanger 1 sits on the counter-flow heat exchangers 2 with two lateral side edges only, however, with the deflector plate 5 arranged between cross-flow heat exchanger 1 and counter-flow heat exchangers 2.

The deflector plate 5 is arranged to cover about half of the second outlet 11 of the cross-flow heat exchanger 1. The deflector plate 5 only covers a small portion of the second inlets 20 of the counter-flow heat exchangers 2.

Heat exchanger plates 30 of the cross-flow heat exchanger 1 as well as of the counter-flow heat exchangers 2 are arranged in stacks as indicated by dashed lines.

The heat exchanger plates 30 of the cross-flow heat exchanger 1 are arranged perpendicular to the heat exchanger plates 30 of the counter-flow heat exchangers 2. A flow direction of the second gas flow 200 passing channels formed by the heat exchanger plates 30 is the same in the cross-flow heat exchanger 1 and in the counter-flow heat exchangers 2.

By this rotation of the heat exchanger plates 30 by 90 degrees, a second gas flow 200 from a channel leaving the cross-flow heat exchanger 1 is automatically distributed over several second channels in a counter-flow heat exchanger 2. Thus, flow mixture and thereby second flow uniformity with respect to temperature and pressure may be achieved.

In FIG. 2, the first inlet 12 and the second inlet 10 of the cross-flow heat exchanger 1 are each provided with a perforation plate 6. The perforation plates 6 are provided with a regular array of perforations 60. The perforations 60 of the array are arranged in parallel lines. For a closed-pack arrangement of the perforations 60 in the array, perforations 60 in neighbouring lines are displaced.

Figure 3:
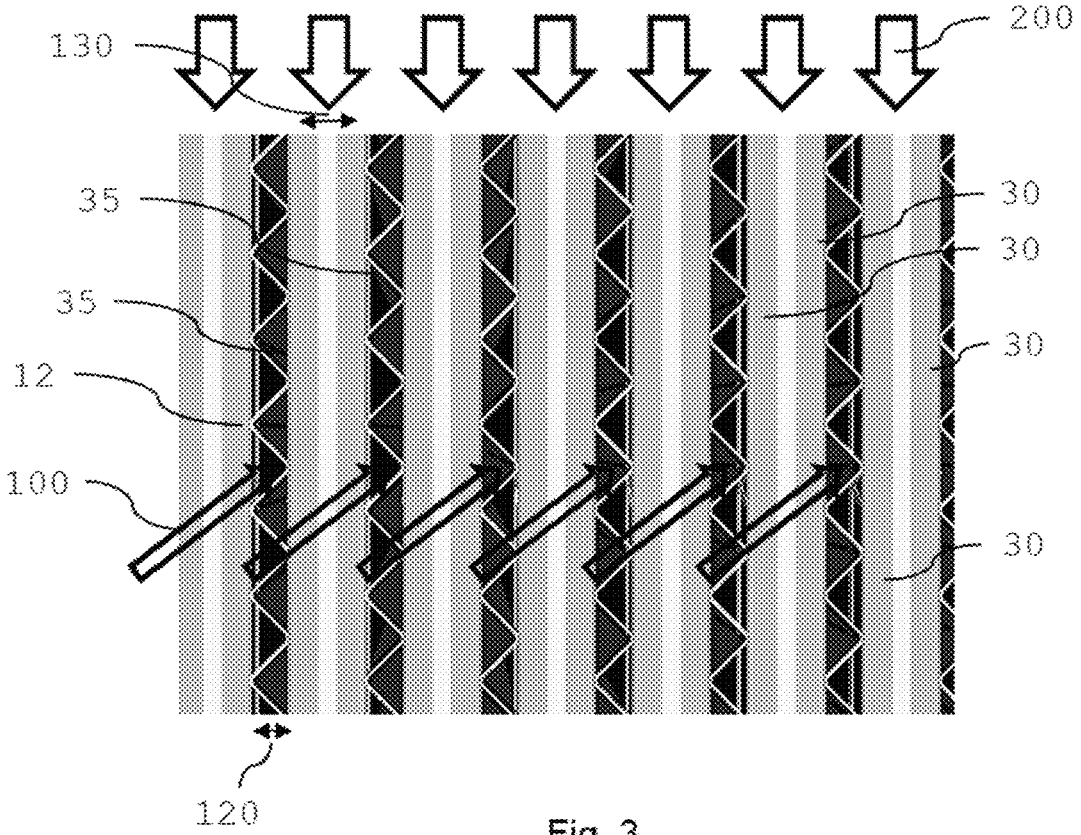
FIG. 3 shows details of a cross-flow heat exchanger.

Preferably, same perforation plates 6 are used for both inlets 10,12 of the cross-flow heat exchanger 1. FIG. 3 shows a schematic set-up of a front side of the cross-flow heat exchanger 1 of FIG. 1.

Several heat exchanger plates 30 are arranged parallel and next to each other. First channels 12 and second channels (not seen in FIG. 3) are formed in between neighbouring heat exchanger plates 30.

Corrugated sheets 35 are arranged in the channels. A peak-to-peak distance of the corrugations of the corrugated sheet 25 corresponds to a channel height or a distance 120,130 between neighbouring heat exchanger plats 30, respectively.

The first channels 12 for the first cold gas flow 100 passing the cross-flow heat exchanger 1 (from front to back) are smaller than the second channels for the hot gas flow 200 passing the heat exchanger (from top to bottom) in a cross-flow manner to the first gas flow 100.

Typically, the distance 130 of neighbouring heat exchanger plates 30 forming the second channels for the second hot gas flow 200 is 1.5 to 3 times, for example two times, larger than the distance 120 between neighbouring plates 30 forming the first channels 12 for the first cold flow 100. By this, a pressure drop of the second large hot gas flow may significantly be reduced in the cross-flow heat exchanger 1.

For example, the distance 130 for the second flow is double the distance 120 of the first flow. In a preferred embodiment, the distance 130 of the plated 30 in the second channel is 2 mm and the distance 120 of the plates 30 in the first channel is 1 mm.

Figure 4:
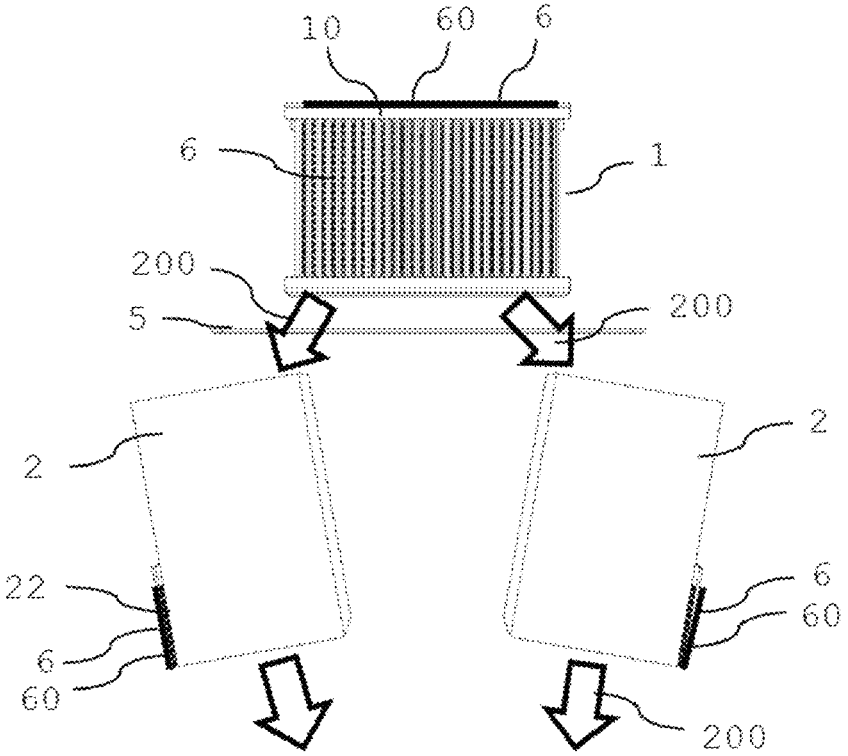
FIG. 4 is a side view of a gas treatment component comprising flow uniforming features.

In FIG. 4 features improving flow uniformity in the gas treatment component are shown.

The deflector plate 5 arranged between cross-flow heat exchanger 1 and counter-flow heat exchangers 2 deflecting a portion of the second gas flow 200 leaving the cross-flow heat exchanger 1 has been described above. The deflector plate 5 may uniform the second gas flow 200 in view of temperature and pressure inhomogeneity caused by the flow regime in the cross-flow heat exchanger 1.

Additionally, perforation plates 6 are arranged to cover the first inlet 12 (not shown in FIG. 4) and the second inlet 10 of the cross-flow heat exchanger 1. A perforation plate 6 is also arranged to cover each of the third inlets 22 of each of the counter-flow heat exchangers 2.

A perforation plate 6 may, for example, comprise holes of 3.5 mm diameter, with the centers of adjacent holes in a row placed at 5 mm distance of each other.

The perforation plate 6 creates turbulence in an inlet gas flow thus leading to a thorough mixture of a gas flow coming, for example, from a single tube, a manifold, or from several individual channels, and that has preferably to be homogenized or to be homogeneously distributed to all inlet channels and preferably over an entire length of all inlet channels of a respective heat exchanger.

No perforation plates 6 are arranged at the second outlets of any of the heat exchangers 1,2.

Figure 5:
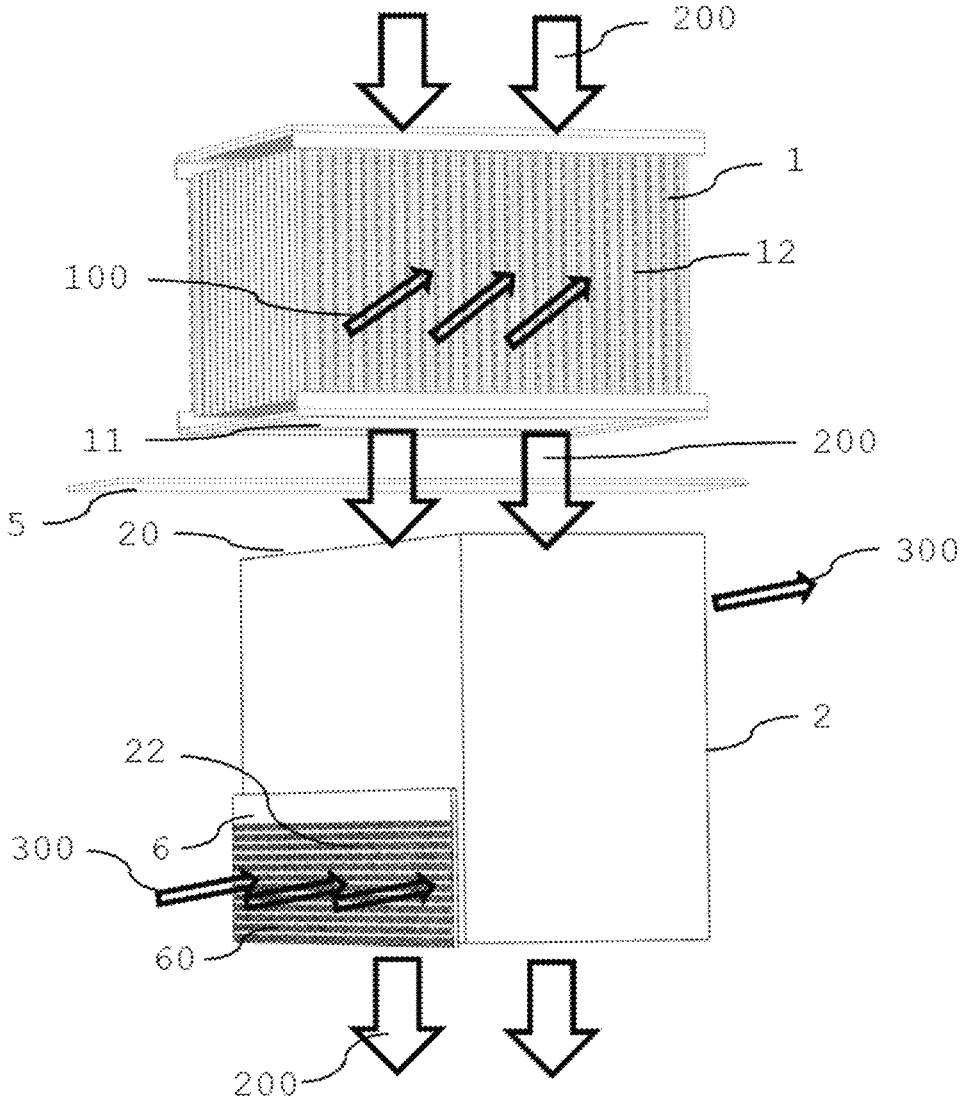
FIG. 5 shows an embodiment of a gas treatment system comprising a single counter-flow heat exchanger.

FIG. 5 shows a gas treatment component comprising a cross-flow heat exchanger 1 arranged above one counter-flow heat exchanger 2. Cross-flow heat exchanger 1 and counter-flow heat exchanger 2 are arranged centrally above each other.

A deflector plate 5 is arranged between the cross-flow heat exchanger 1 and the counter-flow heat exchanger 2. The deflector plate 5 covers about 50 percent of the outlet 11 of the cross-flow heat exchanger 1. The bottom side of the cross-flow heat exchanger 1 with the second outlet 11, the plane of the deflector plate 5 and the top side of the counter-flow heat exchanger 2 with the second inlet 20 are arranged parallel to each other.

The third inlet 22 of the counter-flow heat exchanger 2 is provided with a perforation plate 6. The perforations 60 in the perforation plate 6 covering the third inlet 22 are arranged in 12 parallel lines and preferably have a diameter of between 3 mm and 4 mm.

Third inlet 22 and third outlet (not visible in FIG. 5) are arranged at opposite sides of the counter-flow heat exchanger 2. The third inlet 22 is arranged in a bottom region of the counter-flow heat exchanger 2 and the third outlet is arranged in a top region of the counter-flow heat exchanger 2. By this, the third gas flow 300 may flow from bottom to top of the counter-flow heat exchanger 2 in a counter-flow manner to the second gas flow 200, which second gas flow 200 flows in a top-down manner from the top to the bottom of the counter-flow heat exchanger 2.

Perforation plates 6 preferably also arranged at the two inlets of the cross-flow heat exchanger are not shown in FIG. 5.

In exemplary embodiments of the gas treatment component, a hot gas having a temperature of about 900 degree Celsius is cooled in the cross-flow heat exchanger 1 to about 600 degree Celsius. This partially cooled second gas flow 200 is further cooled down to about 150 to 200 degree Celsius in the counter-flow heat exchanger 2.

The invention claimed is:

1. A gas treatment component comprising a cross-flow heat exchanger and a counter-flow heat exchanger arranged in series with the cross-flow heat exchanger, wherein the cross-flow heat exchanger and the counter-flow heat exchanger each comprise a core comprising a stack of heat exchanger plates, wherein the heat exchanger plates of the cross-flow heat exchanger form first channels for a first gas flow passing the cross-flow heat exchanger and form second channels for a second gas flow passing the cross-flow heat exchanger, wherein a first distance between neighbouring heat exchanger plates forming the first channels is smaller than a second distance between neighbouring heat exchanger plates forming the second channels, wherein the cross-flow heat exchanger comprises a second outlet for the second gas flow to leave the cross-flow heat exchanger, wherein a deflector plate is arranged at the second outlet of the cross-flow heat exchanger for deflecting a portion of the second gas flow leaving the cross-flow heat exchanger at the second outlet, and wherein the deflector plate is arranged between the second outlet of the cross-flow heat exchanger and a second inlet of the counter-flow heat exchanger.

2. The gas treatment component according to claim 1, wherein a ratio of the second distance to the first distance is from 1.2 to 6.

3. The gas treatment component according to claim 1, wherein in the cross-flow heat exchanger a corrugated sheet is arranged in between neighbouring heat exchanger plates.

4. The gas treatment component according to claim 1, wherein the deflector plate covers between 30 percent and 70 percent of the second outlet of the cross-flow heat exchanger.

5. The gas treatment component according to claim 1, wherein planes of the heat exchanger plates of the cross-flow heat exchanger are arranged perpendicular to planes of the heat exchanger plates of the counter-flow heat exchanger.

6. The gas treatment component according to claim 1, wherein a perforation plate is arranged to cover a first inlet or a second inlet of the cross-flow heat exchanger.

7. The gas treatment component according to claim 1, comprising a connection cone connecting the cross-flow heat exchanger and the counter-flow heat exchanger.

8. The gas treatment component according to claim 1, comprising two or more counter-flow heat exchangers arranged in series to the cross-flow heat exchanger wherein the counter-flow heat exchangers are arranged in parallel to each other with respect to the second gas flow passing from the cross-flow heat exchanger into the counter-flow heat exchangers.

9. The gas treatment component according to claim 1, wherein the cross-flow heat exchanger is arranged vertically above the counter-flow heat exchanger.

10. The gas treatment component according to claim 4, wherein the cross-flow heat exchanger is arranged vertically above the counter-flow heat exchanger.

11. The gas treatment component according to claim 1, wherein a ratio of the second distance to the first distance is from 1.5 to 4.

12. The gas treatment component according to claim 1, wherein a ratio of the second distance to the first distance is from 1.5 to 3.

13. The gas treatment component according to claim 1, wherein the deflector plate covers between 40 percent and 60 percent of the second outlet of the cross-flow heat exchanger.

14. The gas treatment component according to claim 1, wherein the deflector plate covers 50 percent of the second outlet of the cross-flow heat exchanger.

15. The gas treatment component according to claim 1, comprising two to six counter-flow heat exchangers arranged in series to the cross-flow heat exchanger and wherein the counter-flow heat exchangers are arranged in parallel to each other with respect to the second gas flow passing from the cross-flow heat exchanger into the counter-flow heat exchangers.

16. The gas treatment component according to claim 1, comprising two to four counter-flow heat exchangers arranged in series to the cross-flow heat exchanger and wherein the counter-flow heat exchangers are arranged in parallel to each other with respect to the second gas flow passing from the cross-flow heat exchanger into the counter-flow heat exchangers.

17. A gas treatment system comprising a gas treatment component according to claim 1 and a housing comprising several openings, wherein the gas treatment component is arranged in the housing and is fluidly connectable through the several openings in the housing with gas sources and gas receivers arranged external to the housing.

18. A method for treatment of gas in the gas treatment component according to claim 1, the method comprising:

providing the first gas flow and the second gas flow, and letting the first gas flow and the second gas flow pass the cross-flow heat exchanger in a cross-flow manner;

letting the second gas flow leaving the cross-flow heat exchanger pass the counter-flow heat exchanger; and providing a third gas flow, and letting the third gas flow and the second gas flow pass the counter-flow heat exchanger in a counter-flow manner;

wherein a mass flow of the first gas flow in the cross-flow heat exchanger is between 5 percent and 50 percent of the second gas flow in the cross-flow heat exchanger.

19. The method according to claim 18, wherein the mass flow of the first gas flow in the cross-flow heat exchanger is between 10 percent and 30 percent of the second gas flow in the cross-flow heat exchanger.

20. The method according to claim 18, wherein the second gas flow has a vertical top-down flow direction.

* * * * *